US011131466B2

(12) United States Patent
Pirmez et al.

(10) Patent No.: US 11,131,466 B2
(45) Date of Patent: Sep. 28, 2021

(54) HEAT SOURCE UNIT AND AIR CONDITIONER HAVING THE HEAT SOURCE UNIT

(71) Applicants: DAIKIN INDUSTRIES, LTD., Osaka (JP); DAIKIN EUROPE N.V., Ostend (BE)

(72) Inventors: Pieter Pirmez, Ostend (BE); Satoshi Kawano, Ostend (BE); Akiharu Kojima, Osaka (JP)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 132 days.

(21) Appl. No.: 16/481,277

(22) PCT Filed: Feb. 9, 2018

(86) PCT No.: PCT/JP2018/004605
§ 371 (c)(1),
(2) Date: Jul. 26, 2019

(87) PCT Pub. No.: WO2018/147412
PCT Pub. Date: Aug. 16, 2018

(65) Prior Publication Data

US 2019/0376698 A1 Dec. 12, 2019

(30) Foreign Application Priority Data

Feb. 10, 2017 (EP) ..... 17155592
Feb. 10, 2017 (EP) ..... 17155593
Feb. 10, 2017 (EP) ..... 17155595

(51) Int. Cl.
*F24F 1/24* (2011.01)
*F25B 13/00* (2006.01)
(Continued)

(52) U.S. Cl.
CPC ..... *F24F 1/24* (2013.01); *F25B 13/00* (2013.01); *F25B 41/20* (2021.01); *F25B 41/37* (2021.01); *F25B 2600/2501* (2013.01)

(58) Field of Classification Search
CPC .... F24F 1/24; F25B 5/02; F25B 13/00; F25B 41/20; F25B 41/24; F25B 41/28;
(Continued)

(56) References Cited

U.S. PATENT DOCUMENTS 8,677,772 B2 * 3/2014 Shih ..... B60H 1/00278 62/196.1
8,763,416 B2 * 7/2014 Hika ..... F24F 1/22 62/298
(Continued)

FOREIGN PATENT DOCUMENTS

CN 1860337 A 11/2006
CN 101578488 A 11/2009
(Continued)

OTHER PUBLICATIONS

International Search Report issued in corresponding International application No. PCT/JP2018/004605 dated May 4, 2018 (5 pages).
(Continued)

*Primary Examiner* — Marc E Norman
(74) *Attorney, Agent, or Firm* — Osha Bergman Watanabe & Burton LLP

(57) ABSTRACT

A heat source unit for an air conditioner that includes a refrigerant circuit includes: an external housing; and a cooling heat exchanger that is disposed in the external housing and that is connected to the refrigerant circuit. The external housing accommodates: a compressor connected to the refrigerant circuit; a heat source heat exchanger that is connected to the refrigerant circuit and that exchanges heat between a refrigerant circulating in the refrigerant circuit
(Continued)

and a heat source; and an electric box. The electric box includes a top and a plurality of side walls; accommodates electrical components that control the air conditioner; and further includes an air passage that includes an air inlet and an air outlet. An air flow is induced through the air passage from the air inlet to the air outlet for cooling at least some of the electrical components.

21 Claims, 5 Drawing Sheets

(51) Int. Cl.
*F25B 41/20* (2021.01)
*F25B 41/37* (2021.01)

(58) Field of Classification Search
CPC ..... F25B 41/37; F25B 41/375; F25B 2313/0233; F25B 2400/0409; F25B 2600/2501
USPC ..... 62/199, 200, 259.2
See application file for complete search history.

(56) References Cited

U.S. PATENT DOCUMENTS

| | | | | |
|---|---|---|---|---|
| 2010/0294466 | A1* | 11/2010 | Shimaoka | F24F 1/54 165/104.33 |
| 2013/0319038 | A1 | 12/2013 | Kawase et al. | |
| 2015/0082823 | A1 | 3/2015 | Teraki et al. | |
| 2016/0174411 | A1 | 6/2016 | Lee et al. | |
| 2016/0258636 | A1 | 9/2016 | Kim et al. | |
| 2017/0016636 | A1* | 1/2017 | Koo | F24F 1/50 |
| 2019/0376710 | A1* | 12/2019 | Pirmez | F24F 11/30 |
| 2019/0376733 | A1* | 12/2019 | Pirmez | F24F 1/18 |

FOREIGN PATENT DOCUMENTS

| | | | |
|---|---|---|---|
| CN | 103380014 | A | 10/2013 |
| EP | 1684022 | A1 | 7/2006 |
| JP | H05157287 | A | 6/1993 |
| JP | 2010-197031 | A | 9/2010 |
| JP | 2012225537 | A | 11/2012 |
| JP | 2013232526 | A | 11/2013 |
| JP | 2013234802 | A | 11/2013 |
| JP | 5966777 | B2 | 8/2016 |
| JP | 2016-191505 | A | 11/2016 |
| WO | 2013-001829 | A1 | 1/2013 |
| WO | 2015/002493 | A1 | 1/2015 |

OTHER PUBLICATIONS

Extended European Search Report issued in corresponding European application No. 17155592.3 dated Jul. 31, 2017 (5 pages).
Extended European Search Report issued in corresponding European application No. 17155593.1 dated Jul. 31, 2017 (6 pages).
Extended European Search Report issued in corresponding European application No. 17155595.6 dated Aug. 8, 2017 (6 pages).
International Preliminary Report on Patentability issued in corresponding International Application No. PCT/JP2018/004605 dated Aug. 22, 2019 (8 pages).

* cited by examiner

[Fig. 1]
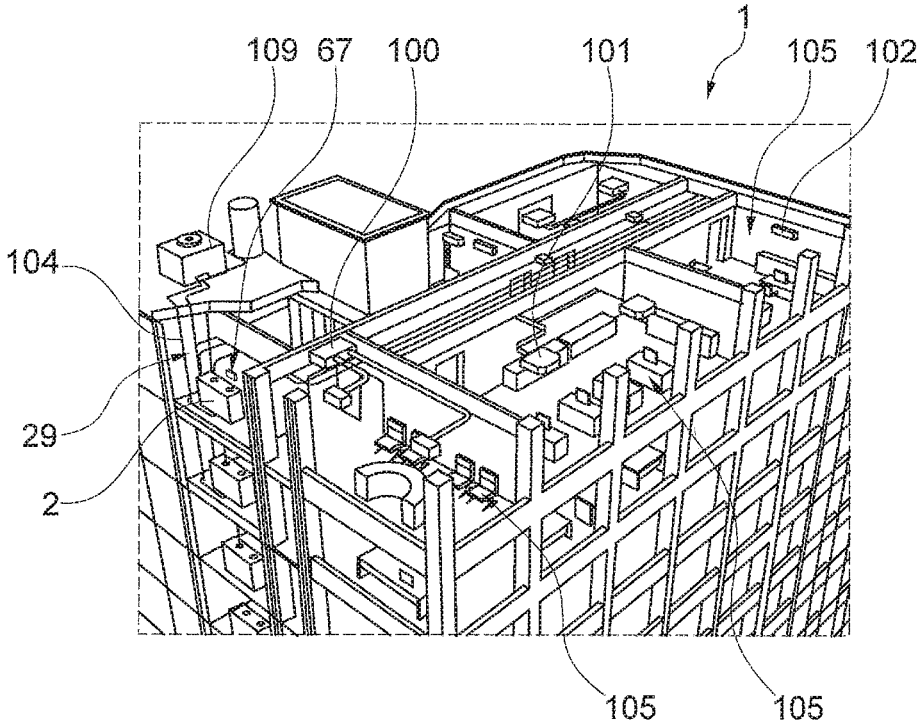
[Fig. 2]
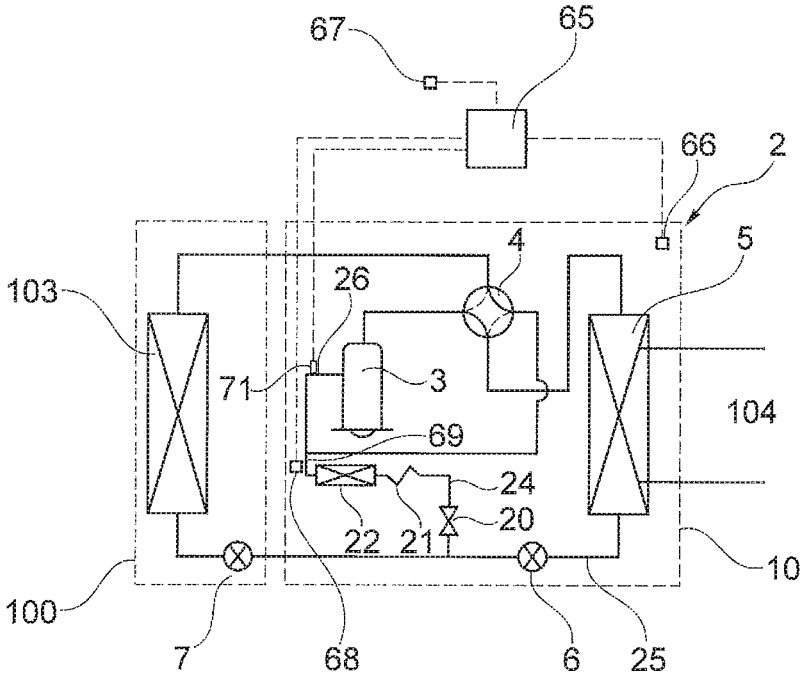

[Fig. 3]
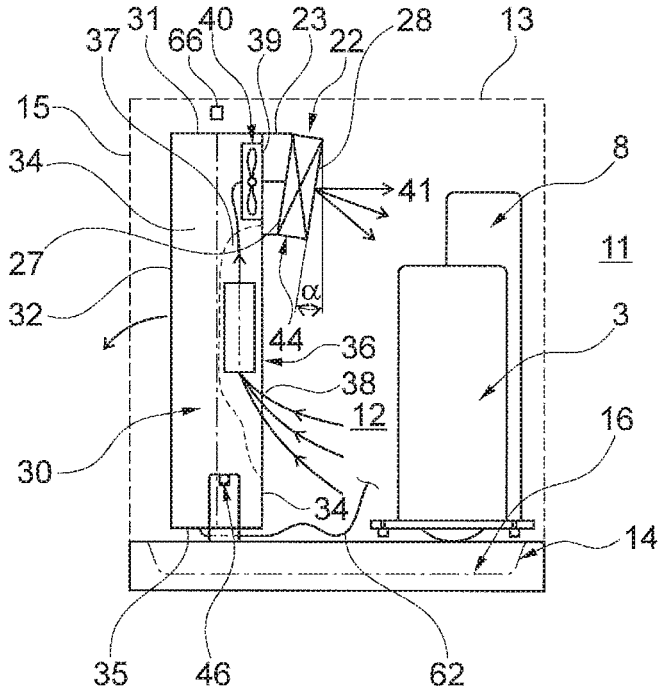
[Fig. 4]
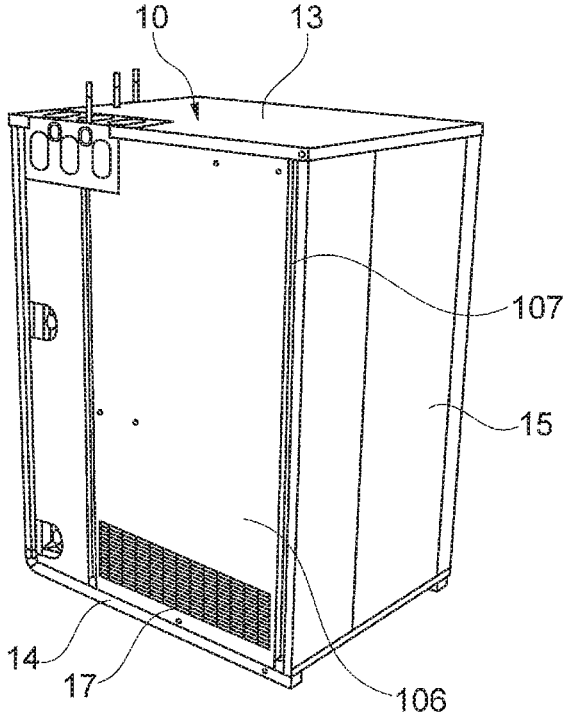

[Fig. 5]
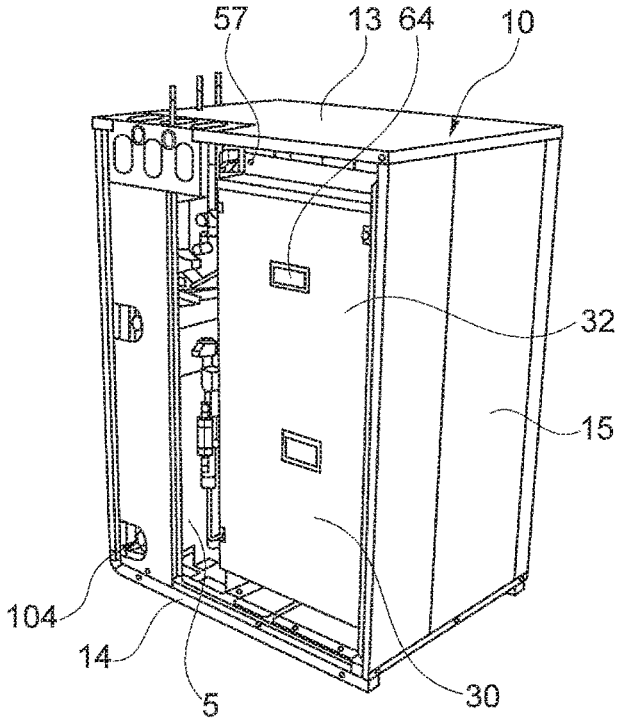
[Fig. 6]
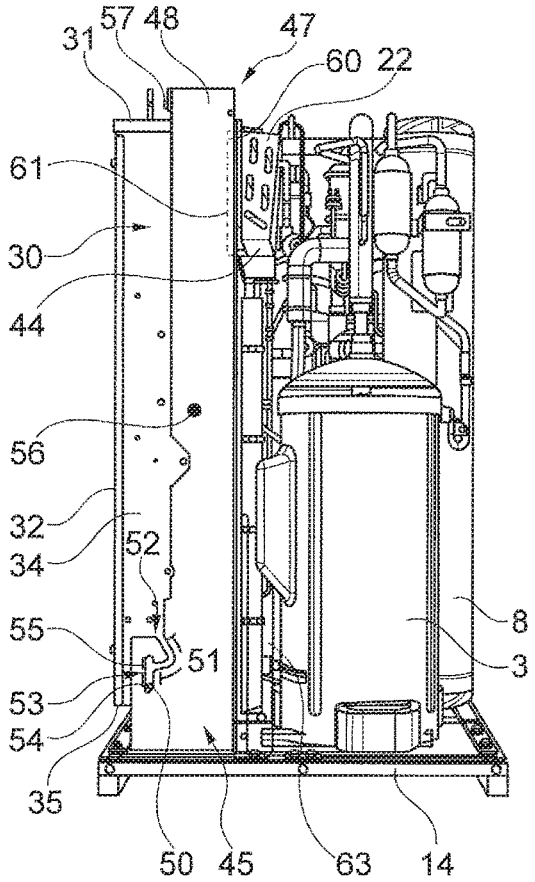

[Fig. 7]
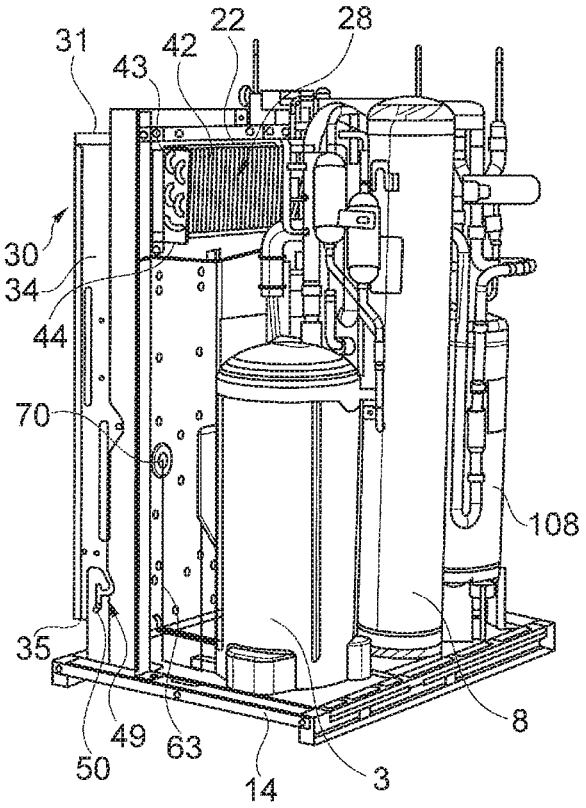
[Fig. 8]
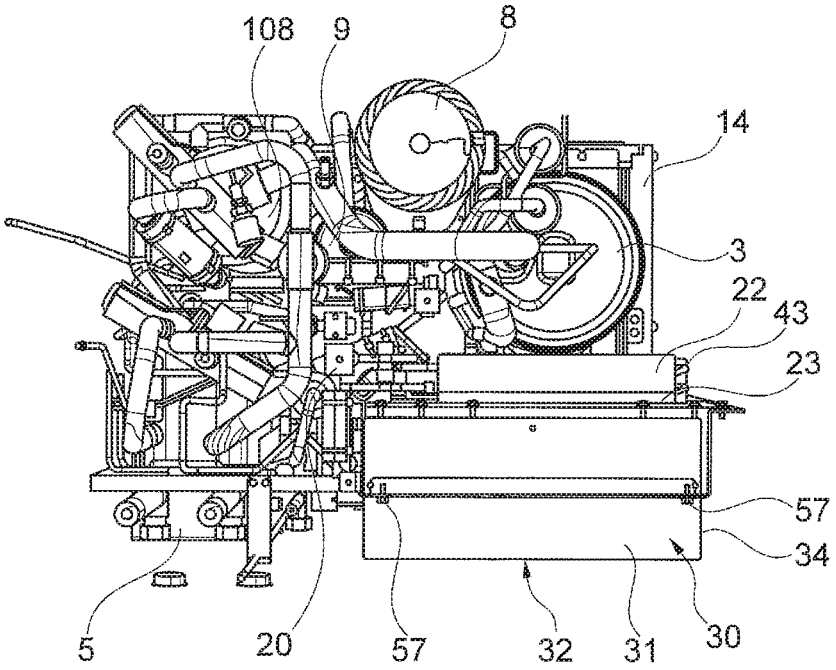

[Fig. 9]
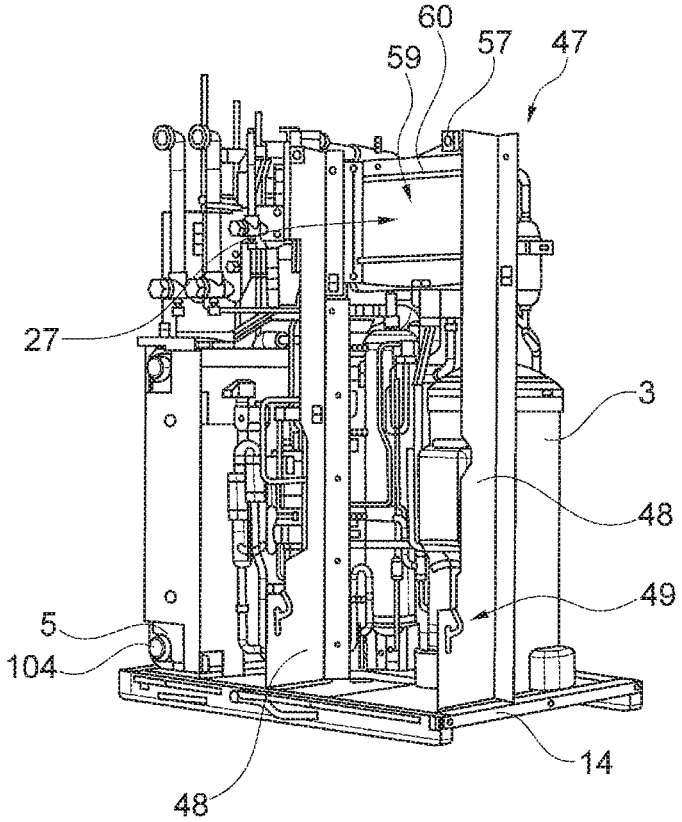
[Fig. 10]
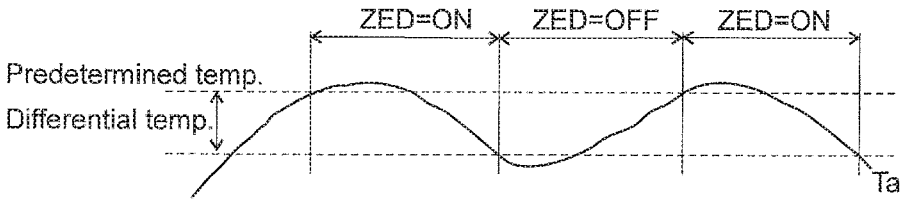

HEAT SOURCE UNIT AND AIR CONDITIONER HAVING THE HEAT SOURCE UNIT

TECHNICAL FIELD

The present disclosure relates to a heat source unit and an air conditioner having the heat source unit.

BACKGROUND

Air conditioners generally employ a heat pump to cool and/or heat air in one or more rooms to be conditioned. The heat pump generally comprises a refrigerant circuit having at least a compressor, a heat source heat exchanger, an expansion valve and at least one indoor heat exchanger. The heat source unit is to be understood as the unit of the air conditioner (heat pump) that comprises the heat source heat exchanger used to transfer heat energy between a source of heat, such as air, ground or water, and a refrigerant flowing in the refrigerant circuit.

Known heat source units generally comprise an external housing accommodating at least the compressor, the heat source heat exchanger and an electric box accommodating electrical components configured to control the air conditioner, particularly the refrigerant circuit of the heat pump.

At least some of the electrical components contained in the electric box require cooling. For this purpose, JP 2016-191505 A discloses an electric box having an air passage comprising an air inlet and an air outlet opening into an interior of the external housing and a fan configured to induce an air flow through the air passage from the air inlet to the air outlet for cooling the electrical components.

The electrical components transfer heat to the air flowing in the air passage. The heated air is subsequently introduced into the interior of the external housing. A similar disclosure may be found in US 2016/0258636 A1.

To support cooling of the electrical components US 2016/0258636 A1 additionally suggests a heat dissipating plate disposed with a first portion in direct contact with an electrical component and with a second portion outside the electric box. A refrigerant piping connected to the refrigerant circuit is coupled to the second portion of the heat dissipating plate. It may for maintenance reasons or to make modifications of a controller contained in the electric box be required to access the electric box. In the configuration of US 2016/0258636 A1 the refrigerant piping has to be disassembled from the second portion of the heat dissipating plate. Due to the fragility of the refrigerant piping, there is a risk of damaging the refrigerant piping.

In addition, hot refrigerant components such as the compressor, a liquid receiver or an oil separator accommodated in the external housing of the heat source unit dissipate heat as well.

The heat source unit is under certain circumstances disposed in an installation environment or space, such as installation rooms inside a building. This is particularly the case when using water as the source of heat. Because the heat source unit as a whole dissipates heat, the temperature in the installation room may increase, which is perceived disadvantageous. If other equipment is also installed in the installation room and the other equipment is sensible to high temperatures, even additional cooling of the installation room may be required.

PATENT LITERATURE

[PTL 1] JP 2016-191505 A
[PTL 2] US 2016/0258636 A1

SUMMARY

One or more embodiments of the present invention provide a heat source unit for an air conditioner and an air conditioner having a heat source unit in which an amount of heat dissipated by the heat source unit can be reduced or even be eliminated.

One or more embodiments of the present invention provide a cooling heat exchanger to be connected to the refrigerant circuit of the air conditioner and flown through by a refrigerant. The cooling heat exchanger is arranged so as to be flown through by the air flow induced through the air passage of the electric box, whereby the air is cooled. As a result, an amount of heat dissipated by the heat source unit, particularly the air expelled from the electric box after cooling the electrical components, can be reduced or even be eliminated. Yet, there is a certain risk that condensation water, which is formed on the cooling heat exchanger due to the temperature difference and humidity in the air, comes into contact with the electrical components. Thus, one or more embodiments may provide a heat source unit and an air conditioner having such a heat source unit in which the risk of condensation water coming into contact with electrical components of the electric box is minimized. Also, yet, implementing such a cooling heat exchanger which has to be mounted in relation to the electric box may lead to increased disassembly work when maintenance of the electric box and/or of other components within the external housing, such as refrigerant components, is required. Thus, one or more embodiments provide a heat source unit for an air conditioner and an air conditioner having such a heat source unit in which maintenance work at the electric box is simplified.

Moreover, it may be an aim to provide a heat source unit for an air conditioner and an air conditioner having such a heat source unit in which a cooling heat exchanger to cool the air flowing through the air passage of the electric box recovers the heat dissipated from the electrical components and uses the heat in the refrigerant circuit of the air conditioner. In this connection, it would be beneficial if the cooling heat exchanger is arranged in the refrigerant circuit so as to enable heat recovery at the same time minimizing any negative effects on a possible capacity and operation of the air conditioner. Further, a simple control mechanism for controlling the refrigerant flow through the cooling heat exchanger is desired to minimize costs.

One or more embodiments may provide a heat source unit for an air conditioner and an air conditioner having such a heat source unit in which access to the electric box is simplified for ease of maintenance.

According to one or more embodiments, a heat source unit as defined in claim 1 is suggested. Further embodiments including an air conditioner having such a heat source unit are defined in the dependent claims, the following description and the drawings.

In accordance with one or more embodiments, a heat source unit for an air conditioner is suggested. In general, the air conditioner may be operated in a cooling operation for cooling a room (or a plurality of rooms) to be conditioned and optionally in heating operation for heating a room (or a plurality of rooms) to be conditioned. If the air conditioner is configured for more than one room even a mixed operation is conceivable in which one room to be conditioned is cooled whereas another room to be conditioned is heated. The suggested air conditioner comprises a refrigerant circuit. As previously indicated the refrigerant circuit may constitute a heat pump and comprise at least a compressor, a heat source heat exchanger, an expansion valve and at least one indoor heat exchanger. The heat source unit according to one or more embodiments comprises an external housing defining an interior of the heat source unit and an exterior of the heat source unit. The external housing accommodates at least the compressor, the heat source heat exchanger, an electric box and a cooling heat exchanger. The cooling heat exchanger may function as an evaporator in the refrigerant circuit and may, hence, also be referred to as an evaporator. The external housing may further accommodate an expansion valve, a liquid receiver, an oil separator and an accumulator of the refrigerant circuit. The components of the refrigerant circuit accommodated in the external housing, particularly the compressor and the heat source heat exchanger are to be connected to the refrigerant circuit. Further, the heat source heat exchanger is configured to exchange heat between a refrigerant circulating in the refrigerant circuit and a heat source, particularly water even though air and ground are as well conceivable. The electric box accommodates electrical components which are configured to control the air conditioner, particularly the heat pump. The electric box has at least a top and side walls. A bottom end of the electric box may either be open or has a bottom. The side walls extend in general along a vertical direction from the bottom to the top. "Along the vertical direction" in this context does not require that the side walls are oriented vertical even though this is one possibility. Rather, the side walls may also be inclined to the vertical direction. As long as the side walls are not angled more than 45° to a vertical direction, the side walls are to be understood as extending along the vertical direction. In order to enable cooling of at least some of the electrical components contained in the electric box, an air passage comprising an air inlet and an air outlet is suggested. According to one or more embodiments, at least the air outlet is arranged in the electric box so as to open into the interior of the external housing. This is particularly preferred if also hot refrigerant components accommodated in the external housing are to be cooled as will be described later. Yet, it is also conceivable that the air outlet opens to the external of the external housing. The air inlet may either be arranged so as to open to the exterior of the external housing or into the interior of the external housing. An air flow through the air passage from the air inlet to the air outlet may be induced by natural convection. Alternatively, a fan may be provided either at the air inlet or the air outlet to induce the air flow as described later. A cooling heat exchanger to be connected to the refrigerant circuit of the air conditioner is suggested so as to minimize the amount of heat from the electrical components being dissipated into the surroundings of the heat source unit. The cooling heat exchanger is arranged at one of the side walls of the electric box so as to be flown through by the air flow and exchange heat between the refrigerant and the air flow.

Accordingly, in one case the air introduced through the air inlet may be cooled by heat transfer between the air and the refrigerant flowing through the cooling heat exchanger, whereby the temperature of the refrigerant is increased and at least some of the refrigerant evaporates. Accordingly, the temperature of the air flowing into the air passage through the air inlet is lower than the temperature of the air in the interior of the external housing or the environment of the heat source unit. Thus, the air expelled through the air outlet may have a temperature similar to that of the air in the external housing or the environment of the heat source unit. As a result, the electrical components do not further heat up the interior of the external housing and the amount of heat dissipated to the exterior (environment) can be reduced. In addition, disposing the cooling heat exchanger at the side walls of the electric box enables efficient use of a large heat exchange surface of the cooling heat exchanger without the need of increasing the width and/or the height of the electric box for fixing the cooling heat exchanger. Thus, this arrangement makes beneficial use of the available mounting space. In addition, arranging the cooling heat exchanger at a side wall of the electric box assists preventing any condensation water from coming into contact with the electrical components in the air passage.

If the cooling heat exchanger was disposed upstream of the electrical components in the air passage (e.g. at the air inlet of the air passage) it is, however, conceivable that sweat is generated on the inside of the electric box because of the relatively cool air introduced into the air passage and the high temperature difference between the air passage and the electric box. To prevent the formation of sweat, the cooling heat exchanger is, hence, disposed downstream of the electrical components to be cooled in the direction of the air flow. The cooling heat exchanger may for example be disposed at the air outlet of the air passage. Accordingly, the air flowing into the air inlet from the interior of the external housing flows through the air passage and cools the electrical components in the air passage, whereby the temperature of the air increases. Subsequently, the air is cooled by flowing through the cooling heat exchanger, wherein the temperature of the refrigerant flowing through the cooling heat exchanger is increased and the refrigerant evaporates. The air expelled from an air outlet of the cooling heat exchanger has a temperature which is at least similar if not the same as the temperature of air in the interior of the external housing and may even be lower. Hence, the electrical components do not further heat up the air in the interior of the external casing and hence heat dissipation to the exterior surroundings may be reduced. Furthermore, there is a risk that condensation water is formed on the surfaces of the cooling heat exchanger as explained earlier. Because the cooling heat exchanger is arranged downstream of electrical components of the electrical components and/or a heat sink heat conductively connected to electrical components of the electrical components which are disposed in the air flow, i.e. in the air passage, the risk is reduced that condensation water will come in contact with the electrical components or the heat sink. In particular, as the air flow is away from the electrical components and the heat sink in the air passage, the air flow will rather transport any condensation water away from the electrical components and the heat sink. In addition, the risk of sweat formation inside the electric box is reduced. Moreover, disposing the cooling heat exchanger downstream of the electrical components to be cooled has the advantage that a larger amount of heat may be transferred to the refrigerant so that heat recovery and the use of heat in the refrigerant circuit are improved.

As previously mentioned, it is conceivable to provide at least one fan to induce the air flow through the air passage from the air inlet to the air outlet. Accordingly, efficiency of cooling of the electrical components and the heat transfer between the air flow and the refrigerant in the cooling heat exchanger may be enhanced because a larger air flow may be generated as compared to natural convection.

According to one or more embodiments, the fan is disposed at the air outlet. This has the advantage that maintenance of the fan is simplified, because the fan is easily accessible even from the outside of the electric box.

To even further improve the effect of preventing condensation water coming in contact with the electrical components and the heat sink, it may be advantageous to dispose the cooling heat exchanger downstream of the fan. Hence, a relatively large air flow "blows" any condensation water on the cooling heat exchanger away from the air passage and the air outlet. Moreover, the fan can then form a barrier between the electrical components and the air passage and the cooling heat exchanger further preventing any condensation water from entering the air passage. A further advantage of this configuration may be that the efficiency of the fan is higher if it is disposed upstream of the cooling heat exchanger so that less power is required to drive the fan.

As indicated in the introductory portion, also other components of the refrigerant circuit (heat pump) are accommodated in the external housing dissipating heat because of hot refrigerant flowing through the components in use. One example of such a hot refrigerant component is the compressor. Other examples are an oil separator or a liquid receiver. In order to decrease the amount of heat dissipated from these components to the exterior of the heat source unit, the cooling heat exchanger may be oriented and particularly an air outlet of the cooling heat exchanger may be oriented or configured to expel the air leaving the cooling heat exchanger in a direction of hot refrigerant components accommodated in the external housing comprising at least one of the group consisting of the compressor, an oil separator and a liquid receiver. In one particular example, the cooling heat exchanger may have a duct connecting at one end to the air outlet of the air passage and at an opposite end to an air inlet of the cooling heat exchanger. The duct may form a passage changing the direction of the air flow from the air outlet of the electric box to the air inlet of the cooling heat exchanger. Thus, common plate-shaped heat exchangers may be used as cooling heat exchanger. The change of the flow direction is then achieved by the duct and the common plate-shaped heat exchanger is attached in an inclined orientation relative to the vertical direction to the duct, whereby the air outlet of the heat exchanger (cooling heat exchanger) is directed to the direction of the hot refrigerant components, whereby the air flow is directed on and cools the hot refrigerant components within the external housing. As a consequence, the heat dissipated from the hot refrigerant components to the interior of the external housing and, hence, the environment of the heat source unit can be reduced even further.

According to one or more embodiments, the air outlet of the air passage is located closer to a top than to a bottom of the external housing. In one or more embodiments, the air outlet of the air passage is located closer to the top than to a bottom end of the electric box. The above arrangement provides for the beneficial effect that natural convection within the interior of the external housing is promoted because relatively cool air is expelled from the air outlet of the air passage at a relatively high position within the external housing which because of natural convection than automatically flows down to the bottom of the external housing.

According to one or more embodiments, the cooling heat exchanger may be connected to a bypass line branched from a liquid refrigerant line and a gas suction line. "Liquid refrigerant line" is in this context to be understood as a line of the refrigerant circuit in which the flowing refrigerant is in the liquid phase. "Gas suction line" is in this context to be understood as a line of the refrigerant circuit on a suction side of the compressor in which gaseous refrigerant flows. According to an example, the liquid refrigerant line is a line connecting the heat source heat exchanger and the indoor heat exchanger. Furthermore, the bypass line may be connected to the liquid refrigerant line in this example with an expansion valve interposed between the bypass line and the heat source heat exchanger. In one particular example, the gas suction line may be a line connected to a suction side of the compressor with one or more components, such as an accumulator, that may be interposed. To put it differently, the cooling heat exchanger is connected to a bypass line branched from a liquid refrigerant line, e.g. connected to the heat source heat exchanger, and a gas suction line, e.g. connected to a suction side of the compressor. Yet, it is also conceivable that an accumulator is disposed between the connection of the bypass line to the gas suction line and the suction side of the compressor. According to one or more embodiments, the cooling heat exchanger may always be operated as long as the compressor is operating so that a reliable system is obtained without negatively affecting the refrigerant circuit of the air conditioner. In addition, this arrangement provides for an efficient use of the heat dissipated from the electrical components in the refrigerant circuit during heating operation of the air conditioner.

The bypass line may have an expansion valve, wherein the opening degree of the expansion valve is controllable. Yet, according to one or more embodiments, the bypass line may have a valve and a capillary both upstream of the cooling heat exchanger. According to one or more embodiments, the valve is switched ON/OFF only, that is the valve is (completely) opened/closed only. The valve may be a solenoid valve. The use of a controlled expansion valve enables a more sophisticated control. Yet, this is not under all circumstances necessary with respect to the cooling heat exchanger flown through by the air flow. Thus, the use of a valve and a capillary instead of the expansion valve provides for a simpler configuration, which is less costly and can dispense the more complicated control logic necessary when using an expansion valve. In either case, it is possible to adapt the cooling performance of the cooling heat exchanger on the needs of the system and the circumstances such as operation conditions of the air conditioner.

As previously indicated, there is a certain risk that condensation water is accumulated on the surfaces of the cooling heat exchanger. According to one or more embodiments, a bottom end portion of the cooling heat exchanger slopes downward towards an air outlet of the cooling heat exchanger. For example, the cooling heat exchanger may have a bottom plate being arranged so as to slope downward towards the air outlet of the cooling heat exchanger. Accordingly, any condensation water which drops or flows down from the cooling heat exchanger will be guided by the bottom end portion, e.g. the bottom plate, from an air inlet of the cooling heat exchanger to an air outlet of the cooling heat exchanger, at which position the condensation water may drop down into a drain pan accommodated in the external housing. Thus, any condensation water is guided away from the air inlet of the cooling heat exchanger. As a result, it can surely be prevented that any condensation water will flow into the air passage and come in contact with the electrical components or the heat sink.

According to one or more embodiments, the cooling heat exchanger has a plurality of fins and tubes, wherein the fins are arranged with a longitudinal extension along a vertical direction. The fins are in principle plate shaped having a length and a width much larger than a height. Thus, the length and the width define a main surface of the fins. The tubes generally extend perpendicular to the main surfaces of the fins. "Along a vertical direction" is, in this context, to be understood in the same manner as explained with respect to the side walls above. In particular, the fins do not need to be oriented vertical but merely need to extend in a direction from a bottom to a top of the external housing. In one example, the fins are with a longitudinal extension inclined relative to the vertical direction. This is particularly the case, if the cooling heat exchanger is inclined to expel the air toward the hot refrigerant components in the external housing as described above. Due to the orientation of the fins along a vertical direction, any condensation water flows along the fins from a top end portion to the bottom end portion of the cooling heat exchanger. Particularly in combination with the bottom end portion sloping downward toward the air outlet of the air conditioner, this ensures that all condensation water of the cooling heat exchanger is guided away from the air passage.

Also, in order to enable simple maintenance of the components contained in the electric box and/or refrigerant components in the external housing (see later), it is suggested to independently mount the electric box and the cooling heat exchanger in the external housing.

As a result, the electric box may be disassembled and accessed without having to dismount the cooling heat exchanger, which may remain mounted in the external housing in the same position even if the electric box is removed. As a consequence, there is no risk of damaging the cooling heat exchanger and the disassembly work for maintenance can be reduced.

The cooling heat exchanger will have to be connected to the refrigerant circuit of the air conditioner by refrigerant piping. The refrigerant piping tends to be frangible (see introductory portion). Accordingly and in order to avoid damaging of the refrigerant piping, the refrigerant piping accommodated in the external housing and connected to the cooling heat exchanger is as well mounted independently from the electric box. Accordingly, when accessing the electric box, no disassembly of the refrigerant piping associated or connected to the cooling heat exchanger is required and the refrigerant piping may remain in the same position and may remain connected to the cooling heat exchanger. Thus, any damaging of the refrigerant piping during maintenance work of the electric box is avoided.

The refrigerant piping may be a bypass line branched from a liquid refrigerant line and a gas suction line. "Liquid refrigerant line" is in this context to be understood as a line of the refrigerant circuit in which the flowing refrigerant is in the liquid phase. "Gas suction line" is in this context to be understood as a line of the refrigerant circuit on a suction side of the compressor in which gaseous refrigerant flows. According to an example, the liquid refrigerant line is a line connecting the heat source heat exchanger and the indoor heat exchanger. Furthermore, the bypass line may be connected to the liquid refrigerant line in this example with an expansion valve interposed between the bypass line and the heat source heat exchanger. In one particular example, the gas suction line may be a line connected to a suction side of the compressor with one or more components, such as an accumulator, that may be interposed. To put it differently, the cooling heat exchanger is connected to a bypass line branched from a liquid refrigerant line, e.g. connected to the heat source heat exchanger, and a gas suction line, e.g. connected to a suction side of the compressor. Yet, it is also conceivable that an accumulator is disposed between the connection of the bypass line to the gas suction line and the suction side of the compressor. According to one or more embodiments, the cooling heat exchanger may always be operated as long as the compressor is operating so that a reliable system is obtained without negatively affecting the refrigerant circuit of the air conditioner. In addition, this arrangement provides for an efficient use of the heat dissipated from the electrical components in the refrigerant circuit during heating operation of the air conditioner.

The bypass line may have an expansion valve, wherein the opening degree of the expansion valve is controllable. Yet, according to one or more embodiments, the bypass line may have a valve and a capillary both upstream of the cooling heat exchanger. According to one or more embodiments, the valve is switched ON/OFF only, that is the valve is (completely) opened/closed only. The valve may be a solenoid valve. The use of a controlled expansion valve enables a more sophisticated control. Yet, this is not under all circumstances necessary with respect to the cooling heat exchanger flown through by the air flow. Thus, the use of a valve and a capillary instead of the expansion valve provides for a simpler configuration, which is less costly and can dispense the more complicated control logic necessary when using an expansion valve. In either case, it is possible to adapt the cooling performance of the cooling heat exchanger on the needs of the system and the circumstances such as operation conditions of the air conditioner.

Because of a positioning of the cooling heat exchanger and the electric box relative to each other is to be realized so that the cooling heat exchanger may be flown through by the air flow flowing through the air passage of the electric box, one or more embodiments provide a support structure. The support structure is accommodated in the external housing and may be fixed to a bottom of the external housing. In one example, the support structure may extend from the bottom along a vertical direction as defined above. In one or more embodiments, the cooling heat exchanger and the electric box are both fixed to the support structure so as to ensure their relative positional relationship. Because the cooling heat exchanger and the electric box are fixed to the support structure independent from each other, the electric box and the cooling heat exchanger may be disassembled from the support structure independent from each other. In one example, the support structure may be a frame having two upright columns connected at one end by a crossbar. The columns are at the opposite end fixed to the bottom of the external housing. Yet, also other support structures are conceivable.

According to one or more embodiments, the electric box is at the first end hinged to the support structure and at the second opposite end releasably fixed to the support structure. Hence, the electric box may easily be moved between a use position and a maintenance position in which maintenance at the electric box and improved access to the interior of the external housing and the components accommodated therein are enabled. Accordingly, it is possible to release the electric box at the second end and to rotate the electric box about an axis of the hinge at the first end, whereby the electric box is rotated into the maintenance position. In one example, the electric box may be rotated about the axis out of the external housing. For this purpose, it is conceivable to remove at least a part of a side wall of the external housing forming an opening in the external housing. The electric box may then be rotated about the axis through the opening of the external housing enabling maintenance work at the electric box without having to completely remove the electric box. In one or more embodiments, the axis of rotation may either be fixed or may be a floating axis of rotation, e.g. as explained below with respect to a slot/boss combination.

One possibility to realize the hinge is that one of the support structure and the electric box comprises opposite slots and the other of the electric box and the support structure comprises opposite bosses engaged with the slots. Therefore and despite a certain weight of the electric box, a relatively simple hinge can be realized. In one or more embodiments, the bosses represent the axis of rotation. In addition, this configuration allows a simple mechanism to allow both, rotation of the electric box into the maintenance position and removal of the electric box. For the latter case, it may be beneficial that the slots have an opening at one end (insertion portion) configured to introduce the bosses, respectively, and an engagement portion in which the bosses are engaged for rotation between the use position and the maintenance position. Moreover, the bosses may be located at the electric box and the slots may be located in the support structure for better EMC (electromagnetic compatibility).

In order to prevent that the bosses inadvertently disengage from the slots when rotating the electric box from the use position into the maintenance position, the slots are shaped to prevent such disengagement of the bosses from the slots, when the electric box assumes the maintenance position. For this purpose, the slots may have the engagement portion mentioned previously. The engagement portion may have a lower section supporting the boss in the use position in an upward direction and an upper section supporting the boss in the maintenance position in a downward direction. In one or more embodiments, the engagement portion extends in opposite directions from a connection to the insertion portion of the slot. In another specific example, the slot may have a lying T-shaped portion, wherein an upwardly extending leg of the T is configured to prevent disengagement of the boss from the slot, when the electric box assumes the maintenance position.

In one or more embodiments, a sealing is provided between the cooling heat exchanger and the electric box. According to an example, the sealing is fixed to the support structure. In another example it is however also conceivable to fix the sealing to the electric box. In either case, the sealing may be configured so as to surround the air outlet of the air passage. The sealing has the purpose of sealing the interface between the electric box and the cooling heat exchanger to avoid air flowing in the air passage to escape at the interface and bypassing the cooling heat exchanger and/or the air passage. The sealing may be realized by an elastic sealing material. Certainly, other or further possibilities to seal between the air outlet of the air passage, i.e. the electric box and the cooling heat exchanger are conceivable. For example, the sealing could also be established by correct dimensioning and adding sufficient fixation points between the mating surfaces so that sufficient sealing is obtained between the mating surfaces. Moreover, a separate clamping element may be used to press the mating surfaces together.

As previously indicated, the electric box may be hinged to the support structure so as to be rotatable about an axis of rotation between the use position and the maintenance position. In one example, the center of gravity of the electric box is located between the axis of rotation and the contact surface of the sealing, particularly a plane defined by the contact surface of the sealing. The contact surface may be a surface of the elastic sealing material facing the electric box, particularly the air outlet of the electric box or one of the mating surfaces such as the mating surface on the side of the cooling heat exchanger. This ensures that proper contact of the contact surface of the sealing with the electric box (if the sealing is e.g. fixed to the support structure) or with the support structure or the cooling heat exchanger, respectively (if the sealing is e.g. fixed to the electric box). In other words, the elastic material of the sealing is or the mating surfaces representing the sealing are always pressed by the weight of the electric box inducing a rotation of the electric box about the axis of rotation in a direction towards the contact surface of the sealing.

As previously mentioned, it is conceivable to provide at least one fan to induce the air flow through the air passage from the air inlet to the air outlet. Accordingly, efficiency of cooling of the electrical components and the heat transfer between the air flow and the refrigerant in the cooling heat exchanger may be enhanced because a larger air flow may be generated as compared to natural convection. According to one or more embodiments, the fan is fixed to the electric box and disposed at the air outlet. This has the advantage that maintenance of the fan is simplified, because the fan is easily accessible even from the outside of the electric box and will automatically be disassembled when the electric box is disassembled or moved into the maintenance position as described above.

According to one or more embodiments, the electric box comprises a handle facing toward an exterior of the external housing. In particular, the handle may be provided in a side wall of the electric box facing a side wall of the external housing. The handle simplifies the disassembly of the electric box. Particularly, the handle can be used for moving the electric box into the maintenance position as described above. For this purpose, the handle may be disposed in a side wall parallel to the axis of rotation and distanced from the axis of rotation.

The electric components of the electric box need to be electrically connected to the components contained in the external housing. Yet, if the electric box is disassembled or moved into the maintenance position as described above, one needs to avoid any strains to be applied onto the electric wires connecting the electric components and the components such as the components of the refrigerant circuit contained in the external housing. For this purpose, a first electric wire connected to a first electric component in the electric box and a first device accommodated in the external housing, such as a valve, the compressor, etc. is guided through the bottom end of the electric box. Particularly, if the axis of rotation is close to the bottom end of the electric box, strains to the electric wire can surely be avoided as the opening in the bottom end is moved toward the interior of the external housing and, thus, necessarily in a direction toward the first device. As a result, the distance between the first electric component and the first device is reduced during the movement and strains on first electric wire can surely be avoided.

Even though it is preferred that substantially all electric wires exit the electric box at the bottom end, the requirements for electromagnetic compatibility (EMC) have to be met. For this purpose, it may be that a second electric wire is connected to a second electric component in the electric box and a second device (e.g. the compressor) accommodated in the external housing, wherein the electric box has a second opening at a position between the bottom end and the top and the second electric wire is guided from the second electric component through the second opening towards the bottom end and from the bottom end towards a position at the second device at a height between the bottom end and the top of the electric box. Thus, the second electric wire forms a loop (extra length) compensating for any changes in distance from the opening to the second device when moving the electric box from the use position to the maintenance position, thus preventing any strains on the second electric wire.

One or more embodiments provide an air conditioner having a heat source unit according to one or more embodiments as described above. The heat source unit is connected to at least one indoor unit having an indoor heat exchanger forming the refrigerant circuit. As previously indicated, the air conditioner has the refrigerant circuit which may constitute a heat pump. Hence, the refrigerant circuit may comprise the compressor, the heat source heat exchanger, an expansion valve and at least one indoor heat exchanger to form a heat pump circuit. Additional components as known for air conditioners may be included as well such as a liquid receiver, an accumulator and an oil separator. According to one or more embodiments, the air conditioner uses water as a heat source. According to one or more embodiments, the air conditioner is mounted in a building comprising one or more rooms to be conditioned and the heat source unit is installed in an installation environment or space, such as an installation room of the building.

Further aspects, features and advantages may be found in the following description of particular examples. This description refers to the accompanying drawings.

BRIEF DESCRIPTION OF THE DRAWINGS

FIG. 1 shows an example of an air conditioner installed in an office building.

FIG. 2 shows a schematic circuit diagram of a simplified air conditioner.

FIG. 3 shows a schematic side view of a heat source unit with the side walls and the top of the external housing being removed.

FIG. 4 shows an overall perspective view of a heat source unit.

FIG. 5 shows a perspective view of the heat source unit of FIG. 4 with a maintenance plate of the external housing being removed.

FIG. 6 shows a side view of the heat source unit of FIG. 4 with the side walls and the top of the external housing being removed.

FIG. 7 shows a perspective view of the heat source unit of FIG. 4 with the side walls and the top of the external housing being removed.

FIG. 8 shows a top view of the heat source unit of FIG. 4 with the side walls and the top of the external housing being removed.

FIG. 9 shows a perspective view of the heat source unit of FIG. 4 with the side walls and the top of the external housing and the electric box being removed.

FIG. 10 shows a graph showing a control mechanism according to an example.

DETAILED DESCRIPTION

In the following description and the drawings, the same reference numerals have been used for the same elements and repetition of the description of these elements in the different embodiments is omitted.

FIG. 1 shows an example of an air conditioner 1 installed in an office building. The office building has a plurality of rooms 105 to be conditioned such as conference rooms, a reception area and working places of the employees.

The air conditioner 1 comprises a plurality of indoor units 100 to 102. The indoor units are disposed in the rooms 105 and may have different configurations, such as wall-mounted 102, ceiling mounted 101 or duct-type indoor units 100.

The air conditioner further comprises a plurality of heat source units 2. The heat source units 2 are installed in an installation room 29 of the office building. Other equipment such as servers (not shown) may be installed in the installation room 29 as well. In the present example, the heat source units 2 use water as heat source. In the particular example, a water circuit 104 is provided which is connected to a boiler, dry-cooler, cooling tower, ground loop or the like. The water circuit 104 may as well have a heat pump circuit including a refrigerant circuit. An outdoor unit comprising the heat source heat exchanger of this heat pump circuit may be disposed on the roof of the office building and use air as the heat source. Yet, the concept of the heat source unit of the present disclosure is also applicable to other heat sources such as air or ground.

In operation, one or more of the indoor units 100 to 102 may be operated to cool the respective rooms 105 whereas others are operated to heat the respective rooms.

A simplified schematic diagram of the air conditioner is shown in FIG. 2. The air conditioner 1 in FIG. 2 is mainly constituted by an indoor unit 100 and the heat source unit 2. Yet, the air conditioner 1 in FIG. 2 may also have a plurality of indoor units 100. The indoor units may have any configuration such as those described with respect to FIG. 1 above.

Further, FIG. 2 shows the refrigerant circuit constituting a heat pump. The refrigerant circuit comprises a compressor 3, a 4-way valve 4 for switching between cooling and heating operation, a heat source heat exchanger 5, an expansion valve 6, and optional additional expansion valve 7 and an indoor heat exchanger 103. The heat source heat exchanger 5 is additionally connected to the water circuit 104 as the heat source. When the compressor 3 is operated, a refrigerant is circulated in the refrigerant circuit.

In cooling operation, high-pressure refrigerant is discharged from the compressor 3, flows through the 4-way valve 4 to the heat source heat exchanger 5 functioning as a condenser whereby the refrigerant temperature is decreased and gaseous refrigerant condensed. Thus, heat is transferred from the refrigerant to the water in the water circuit 104. Subsequently, the refrigerant passes the expansion valve 6 and the optional expansion valve 7, wherein the refrigerant is expanded before being introduced into the indoor heat exchanger 103 functioning as an evaporator. In the indoor heat exchanger 103, the refrigerant is evaporated and heat is extracted from the air in the room 105 to be conditioned, whereby the air is cooled and reintroduced into the room 105. At the same time, the temperature of the refrigerant is increased. Subsequently, the refrigerant passes the 4-way valve 4 and is introduced into the compressor 3 as low-pressure gaseous refrigerant at the suction side of the compressor 3. In view of the aforesaid, the line connecting the heat source heat exchanger 5 and the indoor heat exchanger 103 is considered a liquid refrigerant line 25. The line connecting the 4-way valve 4 and the suction side of the compressor 3 is considered a gas suction line 26.

In heating operation, high-pressure refrigerant is discharged from the compressor 3, flows through the 4-way valve 4 to the indoor heat exchanger 103 (dotted line of the 4-way valve 4) functioning as the condenser, whereby the refrigerant temperature is decreased and gaseous refrigerant condensed. Thus, heat is transferred from the refrigerant to the air in the room 105 whereby the room is heated. Subsequently, the refrigerant passes the optional expansion valve 7 and the expansion valve 6, wherein the refrigerant is expanded before being introduced into the heat source heat exchanger 5 functioning as an evaporator via the liquid refrigerant line 25. In the heat source heat exchanger 5, the refrigerant is evaporated and heat is extracted from water in the water circuit 104. At the same time, the temperature of the refrigerant is increased. Subsequently, the refrigerant passes the 4-way valve 4 (dotted line of the 4-way valve 4) and is introduced into the compressor 3 as low-pressure gaseous refrigerant at the suction side of the compressor 3 via the gas suction line 26.

The refrigerant circuit shown in FIG. 2 further comprises a bypass line 24 branched from the liquid refrigerant line 25 and connected to the gas suction line 26. In the particular example, the bypass line 24 is connected to the liquid refrigerant line 25 between the expansion valve 6 and the indoor heat exchanger 103. If the optional expansion valve 7 is provided, the bypass line 24 is connected between the expansion valve 6 and the optional expansion valve 7.

The bypass line 24 comprises a valve 20 which may assume an open and a closed position (ON/OFF). The valve 20 may be a solenoid valve. Furthermore, the bypass line 24 comprises a capillary 21. In the particular example, the capillary 21 is disposed downstream of the valve 20 in the direction of the flow of refrigerant during cooling operation. Yet, the valve may as well be disposed downstream of the capillary 21.

Furthermore, a cooling heat exchanger 22 (described in more detail below) is connected to the bypass line 24 downstream of the capillary 21 and the valve 20 in the direction of flow of refrigerant during cooling operation. The function of this cooling heat exchanger 22, the valve 20 and the capillary 21 will be described further below.

In one example, the components contained in the dotted rectangle indicating the heat source unit 2 in FIG. 2 are accommodated in an external housing 10 (see FIG. 4) of the heat source unit 2.

As schematically indicated in FIG. 3 and shown in more detail in FIGS. 4 to 9, the external housing 10 has side walls 15 and a top 13 both shown in a dotted line. Furthermore, the external housing 10 has a bottom 14. Thus, the external housing 10 defines an interior 12 of the external housing 10 and an exterior 11 of the external housing 10 which in one example may be the installation room 29 as an example of an installation environment or installation space (see FIG. 1). In the present example, the bottom 14 has a drain pan 16 for collecting any condensation water accumulated in the external housing 10. The bottom 14 supports the remaining components of the heat source unit 2 to be explained in the following. According to one example, none of the components contained in the external housing 10 is fixed to the side walls 15 or the top 13, but all components are directly or indirectly, via the support structures, fixed to the bottom 14.

As an example, the compressor 3, and a liquid receiver 8 commonly used in refrigerant circuits of air conditioners are shown as a components accommodated in the external housing 10. Further components are an oil separator 9 and an accumulator 108 (see FIG. 7). In this context, the compressor 3, the liquid receiver 8 and the oil separator 9 are considered as hot refrigerant components, because at least a proportion of the refrigerant passing through these components is gaseous and hot. The accumulator 108 in contrast is considered as a cold refrigerant component as only low pressure refrigerant passes through the accumulator 108.

The external housing 10 may have vents 17 to allow ventilation of the interior 12 in case the later described zero heat dissipation control is not active.

Furthermore, the heat source unit 2 comprises an electric box 30. The electric box 30 has the shape of a parallelepiped casing, but other shapes are conceivable as well. In the example, the electric box 30 has a top 31, the side walls (in the present example four side walls, namely a back 32, a front 33 and two opposite sides 34) and a bottom 35. In other embodiments, the bottom may be open. The electric box 30 has a height between the bottom end 35 and the top 31, a depth between the back 32 and the front 33 and a width between the two opposite sides 34. In one or more embodiments, the electric box 30 is longitudinal having a height larger (at least twice as large) than the depth and the width.

The electric box 30 accommodates a plurality of electrical components 36 configured to control the air conditioner and particularly its components such as the compressor 3, the expansion valves 6 and 7 or the valve 20. The electrical components 36 are schematically shown in FIG. 3 only.

The electric box 30 further defines an air passage 37 having an air inlet 38 and an air outlet 39. In one or more embodiments, the air inlet 38 is disposed closer to the bottom 35 or the bottom end of the electric box 30 than the air outlet 39. Even more particular, the air outlet 39 is located adjacent to the top 31 of the electric box 30. Due to the longitudinal configuration of the electric box 30 and it is orientation with respect to the longitudinal extension along a vertical direction, the air outlet 39 is located adjacent to a top 13 of the external housing 10 (closer to the top 13 than to the bottom 14). In addition, both the air inlet 38 and the air outlet 39 open into the interior 12 of the external housing 10.

The electrical components 36, which require cooling, are either directly disposed in the air passage 37 as shown in FIG. 3 and/or a heat sink is provided which is heat conductively connected to electrical components to be cooled and the heat sink is directly disposed in the air passage 37.

Furthermore, one or more embodiments show a fan 40 to induce an air flow 41 (arrows in FIG. 3) from the air inlet 38 to the air outlet 39 through the air passage 37. Accordingly, the air passes the electrical components 36 for cooling, wherein heat is transferred from the electrical components either directly or via the mentioned heat sink to the air flowing through the air passage 37. Certainly, also more than one fan 40 may be provided.

In one or more embodiments, the fan 40 is arranged at the air outlet 39 of the air passage so that air from the interior 12 of the external housing 10 is sucked into the air inlet 38 passes through the air passage 37 and is expelled to the interior 12 of the external housing adjacent to the top 13 of the external housing 10. Accordingly, natural convection is assisted in that relatively cool air is expelled at the top and will naturally flow down towards the bottom 14.

Furthermore and as shown in FIGS. 3, and 6 to 9, the cooling heat exchanger 22 is arranged downstream of the electrical components 36 as seen in the direction of the air flow 41. In the particular example, the cooling heat exchanger 22 is also disposed at the air outlet 39 of the air passage 37 and even downstream of the fan 40 in the direction of the air flow 41. In one example, the cooling heat exchanger 22 is attached to the air outlet 39 via a duct 23. The duct 23 forms an air passage between the air outlet 39 of the air passage 37 and an air inlet 27 of the cooling heat exchanger 22. The duct 23 can be used to change the direction of the air flow 41 and/or to mount a commonly known parallelepiped heat exchanger has the cooling heat exchanger 22 in an angled fashion as will be described later.

As may be best seen in FIG. 7, the cooling heat exchanger 22 has a plurality of tubes 43 curved at end portions of the cooling heat exchanger 22 and passing a plurality of fins 42 schematically indicated in FIG. 7. The fins 42 are longitudinal, plate shaped and extend with their longitudinal extension along a vertical direction, i.e. between the bottom 14 and the top 13. It is to be understood, that extending along a vertical direction is as long realized as a longitudinal centerline of the fins 42 in a side view as in FIG. 3 does not intersect a vertical line at an angle of more than 45°. The fins 42 are flat and have a longitudinal extension (lengths) and widths much larger than the height, whereby a main surface of the fins 42 is defined by the length and the width.

In the particular example, the cooling heat exchanger 22, and particularly the longitudinal direction of the fins 42, is angled by an angle α (see FIG. 3) relative to the vertical direction. Accordingly, an air outlet 28 of the cooling heat exchanger is oriented such that the air flow 41 is directed toward hot refrigerant components, in the present example the compressor 3, the liquid receiver 8 as well as an oil separator 9 (see FIG. 8). The angle α may be in a range between 0° and 25°. As a result, the air cooled by the cooling heat exchanger 22 and expelled from the air outlet 28 of the cooling heat exchanger 22 is also used to cool one or more of the hot refrigerant components. Consequently, the amount of heat dissipated by the heat source unit 2 as such can be reduced.

Moreover, the cooling heat exchanger 22 has a bottom end portion 44 such as a bottom plate. In one or more embodiments, the bottom end portion 44 is downwardly inclined from the air inlet 27 of the cooling heat exchanger 22 towards the air outlet 28 of the cooling heat exchanger 22. In other words, the bottom end portion 44 slopes downward towards a bottom 14 of the external housing 10.

As indicated in the introductory portion, there is a risk that condensation water forms on the cooling heat exchanger 22 because of the humidity in the air in the interior 12 of the external housing 10 and the temperature difference. Yet, the particular example provides several means for guiding any condensation water away from the air outlet 39 of the air passage 37 so as to prevent any water from coming into contact with the electrical components 36 or the heat sink in the air passage 37.

On the one hand and as mentioned above, the fins 42 are oriented with their longitudinal direction along a vertical direction. Accordingly, any condensation water formed on the main surfaces of the fins 42 flows down along the fins 42 and, hence, in a vertical direction due to gravity. On the other hand, the bottom end portion 44 of the cooling heat exchanger 22 is downwardly inclined. Accordingly, any condensation water which has flown down the fins 42 and reaches the bottom end portion 44 is guided by the bottom end portion 44 to the air outlet 28 of the cooling heat exchanger 22. At a front edge of the air outlet 28 of the cooling heat exchanger 22, the condensation water may drop down into the drain pan 16 in the bottom 14 of the external housing 10. Thus, any condensation water is securely guided away from the air outlet 39 of the air passage 37.

In addition and as previously mentioned, the cooling heat exchanger 22 is arranged at the air outlet 39 of the air passage 37 and consequently downstream of the electrical components 36 or the heat sink disposed in the air passage 37 in the direction of the air flow 41. Accordingly, the air flow 41 "blows" any condensation water formed on the cooling heat exchanger 22 in a direction away from the air outlet 39 and the electrical components 36. This configuration also assists preventing condensation water from coming into contact with sensible parts of the electric box 30.

Even further, the fan 40 is disposed between the cooling heat exchanger 22 and to the electrical components 36 in the air passage 37. Accordingly, the fan 40 can be considered as a partition separating the cooling heat exchanger 22 from the air passage 37. Hence, the fan is an additional barrier for condensation water and prevents the condensation water from entering the air passage 37.

The electric box 30 is, in one or more embodiments, supported so as to be rotatable about an axis of rotation 46. The support structure 45 is shown in more detail in FIGS. 6 to 9. Thus, the electric box 30 is hinged to the support structure 45 so as to be movable between a use position shown in FIG. 3 and a maintenance position in which the electric box 30 is tilted about the axis of rotation 46 in a counterclockwise direction shown by the arrow in FIGS. 3 and 6. The axis of rotation 46 is located at a first end of the electric box close to the bottom 35, i.e. opposite to the top 31. Furthermore, the electric box 30 is at the top 31 releasably fixed to the support structure to retain the electric box 30 in the use position by bolts 57 (see FIG. 5).

In one or more embodiments shown in FIGS. 6 to 9, the support structure 45 (best visible from FIG. 9) is formed by a frame 47. The frame 47 is fixed to the bottom 14 of the external housing 10. The frame 47 has two upright columns 48. The columns 48 are mounted to the bottom 14 of the external housing 10.

Each of the columns 48 has at its bottom end close to the bottom 14 of the external housing a slot 49. A boss 50 is provided on either side 34 of the electric box 30 and engaged with one of the slots 49. Different to the schematic view in FIG. 3, the detailed representation of the slot 49 in FIGS. 6 and 7 shows an inserting portion 51 used to insert the boss 50 into the slot 49 or to remove the boss 50 from the slot 49 and, hence, to completely remove the electric box 30 from the heat source unit 2. The inserting portion 51 has an opening 52 at one end for introducing the boss 50. Furthermore, an engagement portion 53 is formed at the opposite end of the inserting portion 51. The engagement portion has a lower section 54 supporting the boss 50 in the use position in an upward direction and an upper section 55 supporting the boss 50 in the maintenance position in a downward direction. The axis of rotation 46 is formed by the bosses 50. It is also clear from the side view of FIG. 6, that the center of gravity 56 of the electric box 30 is arranged so that the electric box 30 tends to rotate about the axis of rotation 46 in a clockwise direction that is towards the interior 12 of the external housing 10.

As previously mentioned, the electric box 30 may be releasably fixed to the frame 47 by bolts 57 (see FIG. 5). When releasing the bolts 57 at the upper end near the top 31 of the electric box 30 from the frame 47, the electric box may be rotated about the axis of rotation 46 or the bosses 50, respectively, in a counterclockwise direction as will be explained in more detail below. For rotating the electric box 30 it is conceivable to provide a handle 64 (see FIG. 5) in or at an outer surface of the electric box 30.

The cooling heat exchanger 22 is in the present example together with the duct 23 fixed to the frame 47 by bolts. As may be best seen from FIG. 9, the air outlet 39 or more particularly an opening 59 of the frame 47 facing the air outlet 39 of the air passage 37 is surrounded by an elastic sealing 60. The elastic sealing 60 is as well fixed to the frame 47. The sealing, particularly the contact surface of the sealing facing the electric box 30 defines a plane 61. The center of gravity 56 is in a side view (FIG. 6) disposed between the plane 61 and the axis of rotation 46 (formed by the boss 50). Thus, the electric box 30 tends to rotate against the contact surface of the sealing 60 by gravity ensuring a proper contact with the sealing at the air outlet 39 between the outlet 39 and the cooling heat exchanger 22 and its optional duct 23. Certainly, other or further possibilities to seal between the outlet 39 and the cooling heat exchanger 22 and its optional duct 23 are conceivable. For example, the sealing could also be established by correct dimensioning and adding sufficient fixation points between the mating surfaces. Moreover, a separate clamping element may be used to press the mating surfaces together.

The electrical components 36 in the electric box 30 need to be connected to some of the components of the refrigerant circuit contained in the external housing 10. For this purpose, the electric box 30 has either an open bottom or an opening is provided in the bottom 35. A first electric wire 62 connected to a first electric component in the electric box 30 leaves the electric box through the bottom end of the electric box 30 and is connected to the first electric component such as the solenoid valve 20 (see FIG. 2 and FIG. 8). For this purpose, the electric wire 62 schematically indicated in FIG. 3 is guided from the bottom 35 to the bottom 14 of the external housing 10, along the bottom 14 and from the bottom 14 to the first electric component (in the example the valve 20).

Under some circumstances and for EMC (electromagnetic compatibility) reasons, some electric wires need to be separated from other electric wires. Accordingly, it is conceivable that a second electric wire 63 leaves the electric box 30 through an opening 70 (see FIG. 7) between the bottom 35 and the top 31 of the electric box 30. Also, the second electric wire 63 is guided to the bottom 14 of the external housing 10 and from the bottom to the component such as the compressor 3. Neither the first electric wire 62 nor the second electric wire 63 is fixed to the bottom 14 of the external housing 10 in the example.

In the case that maintenance of electric components 36 or refrigerant components or the fan of the electric box 30 is required, one has to remove a maintenance wall 106 of the external housing 10 (see FIG. 4). For this purpose, the bolts 107 are removed and subsequently the maintenance wall 106 can be removed as shown in FIG. 5. Once the maintenance wall 106 has been removed, one can loosen the bolts 57 at the top end of the electric box 30 (FIG. 5) and pivot the electric box 30 about the axis of rotation 46, formed by the bosses 50, out through the opening created by removing the maintenance wall 106. During this process, the boss 50 moves from the lower section 54 of the engagement portion 53 of the slot 49 into the upper section 55 of the engagement portion 53 of the slot 49. Accordingly, the electric box 30 is reliably held in the slot 49 and can easily be pivoted.

As will be apparent from the above description, the electric box 30 and the cooling heat exchanger 22 are independently fixed to the support structure 45 (the frame 47). There is no attachment of the electric box 30 to the cooling heat exchanger 22. Accordingly, moving the electric box 30 into the maintenance position (not shown) does not affect the cooling heat exchanger 22 and its refrigerant piping 24. The cooling heat exchanger 22, the duct 23 (if present) and the sealing 60 remain mounted in their position on the frame 47 and are not moved together with the electric box 30. In this context, the fan 40 may as well be fixed to the electric box 30 and may be pivoted into the maintenance position together with the electric box 30 to enable easy maintenance or substitution of a damaged fan 40.

When the electric box 30 is moved into the maintenance position, the first electric wire 62 guided through the bottom 35 of the electric box 30 moves towards the inner side of the external housing 10 and, therefore, in a direction toward the electrical component 20 to which it is connected. Accordingly, no strain is applied to the first electric wire 62 by moving the electric box 30 into the maintenance position.

The second electric wire 63 leaving the electric box through the opening 70 is first guided to the bottom 13 of the external housing 10. Thus, there is a certain free length of the second electric wire 63 between the opening 70 and the connection to the compressor 3. Thus, also in this case strain on the second electric wire 63 can be avoided when moving the electric box 30 into the maintenance position.

The above configuration enables easy access to the electric box and does not require any disassembly/assembly work on the cooling heat exchanger 22 and its refrigerant piping 24. For this reason, damages to the cooling heat exchanger 22 and its refrigerant piping 24 can be prevented.

After the maintenance, the electric box 30 is pivoted about the axis of rotation 46 (bosses 50) in an opposite direction (clockwise in FIGS. 3 and 6) into the use position shown in the drawings. During this process, the boss 50 again moves back to the lower section 54 of the engagement portion 53 of the slot 49 so that the electric box 30 is securely supported in a vertical direction. Because the center of gravity 56 is closer to a plane 61 formed by the contact surface of the sealing 60 than to the axis of rotation 46 (bosses 50) in a side view, the weight of the electric box 30 ensures that the electric box 30 is securely pressed against the contact surface of the sealing 60 and does even without the bolts 57 not "drop" out of the maintenance opening. Subsequently, the bolts 57 are reinserted and the maintenance wall 106 is reinstalled.

Further, a controller 65 is provided which is schematically shown in FIG. 2. The controller 65 has the purpose of controlling the air conditioner 1 and particularly the refrigerant circuit. The controller 65 may be accommodated in the electric box 30.

The controller 65 may be configured to control the air conditioner 1 on the basis of parameters obtained from different sensors.

For example, a first temperature sensor 66 is disposed in the interior 12 of the external housing 10. Thus, the first temperature sensor 66 detects the temperature in the interior 12 of the external housing 10. In this context, the position of the first temperature sensor 66 is determined relative to the position of the other components in the external casing at a position in which a relatively stable and representative temperature can be measured. Thus, this position has to be determined by experiments.

A second temperature sensor 67 may be arranged in the installation room 29 in which the heat source unit 2 is installed. The second temperature sensor 67, hence, measures a temperature in the installation room 29 in other words the temperature of the environment (exterior) of the external housing 10.

Another parameter used by the controller 65 is a thermistor 68 (third temperature sensor) at an exit line 69 between the cooling heat exchanger 22 and a suction side of the compressor 3 (see FIG. 2). In one or more embodiments, it is conceivable that an accumulator 108 is disposed in the line between the cooling heat exchanger 22 and the inlet of the compressor 3 (suction side). In general, the exit line 69 is to be understood as that line connecting the cooling heat exchanger 22 to the gas suction line 26, i.e. between an exit of the cooling heat exchanger 22 and the connection of the bypass line 24 to the gas suction line 26. The thermistor 65 measures the temperature of the refrigerant in the exit line 69. Further, a pressure sensor 71 is provided and configured to measure the pressure of the refrigerant in the gas suction line 26.

The operation of the air conditioner with respect to the cooling heat exchanger 22 is described in more detail below. This operation may also be referred to as the zero heat dissipation control (ZED=zero energy dissipation).

In principle, one can choose between three settings explained in more detail and shown in the table below.

| Setting | 0 | 1 | 2 |
|---|---|---|---|
| Zero heat dissipation control | OFF | ON priority on cooling capacity | ON priority on zero heat dissipation |

In setting "0", the valve 20 is completely closed and no refrigerant flows through the cooling heat exchanger 22. In this setting, the electric components 36 may still be cooled by operating the fan but the heat is dissipated to the interior 12 of the external casing 10, and hence the external casing 10 and the heat source unit 2 dissipate heat to the installation room 29. The zero heat dissipation control is switched OFF.

If setting "1" is selected, zero heat dissipation control is ON. Yet, in this setting, the cooling capacity of the air conditioner has priority over the zero heat dissipation control. In particular, if a temperature measured in a room 105 to be conditioned exceeds a set temperature of the air conditioner in that room 105 by a certain value, and the air conditioner can only satisfy this additional cooling demand if the zero heat dissipation control is deactivated, the valve 20 will be closed. To put it differently, the valve 20 is closed, when a required cooling capacity of the air conditioner exceeds a predetermined threshold. For example, a heat source heat exchanger 5 can transfer a certain amount of heat (further referred to as 100% heat load) to (in this example) water (water circuit 104) at certain operating conditions. During operation with deactivated ZED control, the heat source unit 4 can remove heat from the room (105) in correspondence with 100% heat load (cooling operation). Assuming that the heat loss from the electronic components and hot refrigerant components corresponds to 4% of the total heat load, only 96% of heat load (cooling capacity) can be used to cool the room 105 during cooling operation. If the above setting is activated, the ZED control can be deactivated resulting in a 100% available capacity to cool the room 105. During heating operation of the room 105, the heat source heat exchanger 5 will subtract 100% of heat from the water in the water circuit 104 and deliver this heat, together with the 4% heat loss from the electric components 36, to the room 105. This results in a heating capacity of 104%, whereby the heating performance of the air conditioner 1 is increased.

If setting "2" is selected, zero heat dissipation control is ON independent of the cooling capacity of the air conditioner. However, under certain special control operations, such as start-up and oil return, zero heat dissipation control is still deactivated (the valve 20 is closed) in order to avoid damaging of the compressor 3 due to liquid refrigerant flowing back into the compressor 3. During start-up mode for example, the rotational speed of the compressor increases to nominal speed. At a low rotational speed, the circulated refrigerant amount is low. Yet, if the distance between the heat source unit 2 and the indoor unit 100 is large, the refrigerant in the liquid line connecting the heat source unit 2 and the indoor unit 100 has a relatively high inertia. In contrast, the bypass line 24 is relatively short and has a low inertia. As a consequence, a higher proportion of the refrigerant flows through the bypass line 24, whereas a reduced amount or even no refrigerant may flow to the indoor unit 100. This may result in lower comfort in the room 105 in which the indoor unit 100 is mounted. This may be prevented by closing the valve 20. During oil return operation, a high mass flow rate is generated to flush oil out of the refrigerant circuit components. If the valve 20 is open, the mass flow rate through the refrigerant circuit component was reduced resulting in a decreased oil return efficiency.

In either case, the zero heat dissipation control may be performed on the basis of different parameters.

According to a first possibility, the temperature of the interior 12 of the external casing 10 is measured by the first temperature sensor 66 and the controller 65 controls the valve 20 on the basis of the temperature measured by the first temperature sensor 66.

In particular, the controller 65 compares the temperature measured by the first temperature sensor 66 with a predetermined temperature. In one or more embodiments, it is preferred that one either freely inputs the predetermined temperature or can select from different settings as shown in the table below to define the predetermined temperature.

| Setting | 0 | 1 | 2 | 3 | 4 | 5 | 6 | 7 |
|---|---|---|---|---|---|---|---|---|
| Predetermined temperature [° C.] | 25 | 27 | 29 | 31 | 33 | 35 | 37 | 39 |

Further, one either freely inputs a differential temperature or again selects the differential temperature from different settings as shown in the table below to define the differential temperature.

| Setting | 0 | 1 | 2 | 3 |
|---|---|---|---|---|
| Differential temperature [° C.] | 3 | 2 | 1 | 5 |

According to this control, the controller 65 compares the temperature measured by the first temperature sensor 66 with the predetermined temperature. If the temperature measured by the first temperature sensor 66 exceeds the predetermined temperature, the controller 65 is configured to activate the zero heat dissipation control and open the valve 20 (completely).

Then again and as shown in FIG. 10, if the temperature measured by the first temperature sensor 66 falls below the predetermined temperature minus the selected differential temperature, the controller 65 is configured to deactivate the zero heat dissipation control and close the valve 20 (completely).

For example, if the setting "3" is selected for the predetermined temperature, the predetermined temperature is 31° C. Further, if the setting "0" is selected for the differential temperature, the differential temperature is 3° C. If for example the temperature measured by the first temperature sensor 66 in the interior 12 of the external housing 10 exceeds 31° C., the valve 20 is opened by the controller 65. Accordingly, the refrigerant flows through the capillary 21, is expanded and then flows into the cooling heat exchanger 22. In the cooling heat exchanger, the refrigerant extracts heat from the air flow 41 by heat exchange, whereby the air flow 41 is cooled and cooled air is expelled into the interior 12 of the external housing 10. Thereby also the hot refrigerant components such as the compressor 3, the liquid receiver 8 and the oil separator 9 are cooled, because of the orientation of the air outlet 28 of the cooling heat exchanger 22 in an angled fashion. In particular, the cooled air flow 41 is directed in a direction of the hot refrigerant components which are accordingly cooled. In any case, air that is cooler than the air in the interior 12 of the external housing 10 is expelled from the cooling heat exchanger 22 into the interior 12. As a result, the temperature decreases in the external housing 10. Once the temperature measured by the first temperature sensor 66 falls below 28° C. (31° C.–3° C.), the controller 65 closes the valve 20 and no refrigerant flows through the cooling heat exchanger 22. This process is repeated as shown in FIG. 10.

Alternatively or in addition to the above control, it is also conceivable to use a second temperature sensor 67 disposed in the installation room 29 and measuring the temperature in the installation room 29 to control the valve 20.

In this context, it is conceivable that the zero heat dissipation control is activated (the valve 20 is opened) if the temperature detected by the first temperature sensor 66 is higher than the temperature measured by the second temperature sensor 67. For example, it may be that the controller 65 overrides the above control related to the first temperature sensor 66, if the temperature measured by the second temperature sensor 67 is lower than the temperature detected by the first temperature sensor 66 and closes the valve 20 despite the fact that the temperature measured by the first temperature sensor 66 is higher than the predetermined temperature.

An even further possibility is that instead of using the first temperature sensor 66 to merely use the second temperature sensor 67 and control the valve 20 on the basis of a comparison between the temperature measured by the second temperature sensor 67 and a predetermined temperature in the same manner as explained above with respect to the first temperature sensor 66.

According to a first example, it may be sufficient to compare the predetermined temperature and the temperature measured by the second temperature sensor 67 and if the temperature of the second temperature sensor 67 exceeds the selected predetermined temperature, the valve is opened to activate the zero heat dissipation control. Subsequently, if the temperature measured by the second temperature sensor 67 falls below the predetermined temperature minus the differential temperature, the valve 20 is again closed.

According to a second example, it is as well conceivable to define a second differential temperature in the same manner as the first differential temperature. If the temperature measured by the second temperature sensor 67 is higher than the predetermined temperature and the delta between the temperature measured by the second temperature sensor 67 and the predetermined temperature is higher than the second differential temperature, the valve 20 is opened. In the same manner as described above, if the temperature measured by the second temperature sensor 67 falls below the predetermined temperature by the first differential temperature, the valve 20 is closed and the zero heat dissipation control is deactivated.

An even further control mechanism to activate/deactivate the zero heat dissipation control (open/close the valve 20) may be based on the thermistor 68 disposed at the exit line 69 and particularly the temperature of the refrigerant in the exit line 69 measured by the thermistor 68. Further, the controller 65 uses the pressure measured by the pressure sensor 71 disposed at the gas suction line 26. In particular, the controller 65 concludes on the two-phase temperature (the temperature at which a phase change from liquid to gas takes place) on the basis of the pressure measured by the pressure sensor is 71. Subsequently, the controller 65 compares this two-phase temperature and the temperature measured by the thermistor 68. If the temperature measured by the thermistor 68 is higher than the two-phase temperature, it is concluded that superheated gaseous refrigerant leaves the cooling heat exchanger 22. The output of the thermistor 68 is, hence, used by the controller 65 to conclude or calculate on the basis of a pressure in the gas suction line 26 and the temperature at an outlet of the cooling heat exchanger 22 (cooling heat exchanger gas outlet) on a superheat degree. Subsequently, and depending on the superheat degree the valve 20 is opened or closed. This control is particularly a safety measure to prevent liquid refrigerant from remaining in the exit line 26 and/or being pumped into the accumulator 108 (if present) or the compressor 3. In particular, the controller 65 is configured to switch to the OFF-mode of the valve 20, when the calculated superheat degree falls below a predetermined value for a predetermined period of time. During operation, the pressure difference between the liquid line 25 and the gas suction line 26 will depend on the operational conditions of the heat source unit 2. If there is a pressure drop in the bypass line 24, a refrigerant flow may be induced from the gas suction line 26 into the bypass line 24. Depending on the air temperature in the external housing 10, the refrigerant flowing through the cooling heat exchanger 22 and the thermal capacity of the air may be out of balance resulting in a fully evaporated refrigerant with a possible high superheat or a not fully evaporated refrigerant which contains liquid refrigerant. Those extreme situations may be avoided by opening/closing the valve 20 on the basis of the superheat degree obtained via the thermistor.

REFERENCE SIGNS LIST

Air conditioner 1
Heat source unit 2
Compressor 3
4-Way valve 4
Heat source heat exchanger 5
Expansion valve 6
Optional expansion valve 7
Liquid receiver 8
Oil separator 9
External housing 10
Exterior of the external housing 11
Interior of the external housing 12
Top of the external housing 13
Bottom of the external housing 14
Side walls of the external housing 15
Drain Pan 16
Vents 17
Valve 20
Capillary 21
Cooling heat exchanger 22
Duct 23
Bypass line 24
Liquid refrigerant line 25
Gas suction line 26
Air inlet of cooling heat exchanger 27
Air outlet of the cooling heat exchanger 28
Installation room 29

Electric box 30
Top of the electric box 31
Back of the electric box 32
Front of the electric box 33
Sides of the electric box 34
Bottom of the electric box 35
Electrical components 36
Air passage 37
Air inlet of the air passage 38
Air outlet of the air passage 39
Fan 40
Air flow 41
Fins 42
Tubes 43
Bottom end portion of the cooling heat exchanger 44
Support structure 45
Axis of rotation 46
Frame 47
Column 48
Slot 49
Boss 50
Insertion portion 51
Opening of the insertion portion 52
Engagement portion 53
Lower section 54
Upper section 55
Center of gravity 56
Bolts 57
Opening 59
Sealing 60
Plane of the contact surface of the sealing 61
First electric wire 62
Second electric wire 63
Handle 64
Controller 65
First temperature sensor 66
Second temperature sensor 67
Thermistor 68
Exit line 69
Opening 70
Pressure sensor 71
Indoor unit 100 to 102
Indoor heat exchanger 103
Water circuit 104
Rooms 105
Maintenance wall 106
Bolts 107
Accumulator 108
Outdoor unit 109

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

The invention claimed is:

1. A heat source unit for an air conditioner that comprises a refrigerant circuit, the heat source unit comprising:
an external housing that accommodates:
a compressor connected to the refrigerant circuit;
a heat source heat exchanger that is connected to the refrigerant circuit and that exchanges heat between a refrigerant circulating in the refrigerant circuit and a heat source; and
an electric box that:
includes a top wall and a plurality of side walls;
accommodates electrical components that control the air conditioner; and
further includes an air passage comprising an air inlet and an air outlet, wherein an air flow is induced through the air passage from the air inlet to the air outlet for cooling at least some of the electrical components; and
a cooling heat exchanger that is disposed in the external housing and that is connected to the refrigerant circuit, wherein
the air flow flows through the cooling heat exchanger,
the cooling heat exchanger exchanges heat between the refrigerant and the air flow, and
an air outlet of the cooling heat exchanger is oriented to expel air, from the air passage, that leaves the cooling heat exchanger in a direction of hot refrigerant components disposed in the external housing.

2. The heat source unit according to claim 1, wherein the cooling heat exchanger is disposed at one of the plurality of side walls of the electric box.

3. The heat source unit according to claim 1, wherein the cooling heat exchanger is disposed downstream of at least one of the electrical components and a heat sink that is heat-conductively connected to the electrical components.

4. The heat source unit according to claim 1, wherein a fan is disposed in the external housing and induces the air flow through the air passage from the air inlet to the air outlet.

5. The heat source unit according to claim 4, wherein the fan is disposed at the air outlet.

6. The heat source unit according to claim 1, wherein the air outlet of the air passage is disposed closer to a top than to a bottom of the external housing.

7. The heat source unit according to claim 1, wherein the cooling heat exchanger is connected to a bypass line disposed between a liquid refrigerant line and a gas suction line.

8. The heat source unit according to claim 7, wherein the bypass line comprises a valve and a capillary both upstream of the cooling heat exchanger.

9. The heat source unit according to claim 1, wherein the cooling heat exchanger comprises a plurality of fins and a plurality of tubes, wherein the fins longitudinally extend along a vertical direction from a bottom to a top of the external housing.

10. The heat source unit according to claim 1, wherein the electric box further comprises a handle that faces an exterior of the external housing.

11. An air conditioner having the heat source unit according to claim 1 that is connected to at least one indoor unit, wherein the at least one indoor unit comprises an indoor heat exchanger that forms the refrigerant circuit.

12. A heat source unit for an air conditioner that comprises a refrigerant circuit, the heat source unit comprising:
an external housing that accommodates:
a compressor connected to the refrigerant circuit;
a heat source heat exchanger that is connected to the refrigerant circuit and that exchanges heat between a refrigerant circulating in the refrigerant circuit and a heat source; and
an electric box that:
includes a top wall and a plurality of side walls;
accommodates electrical components that control the air conditioner; and further includes an air passage comprising an air inlet and an air outlet, wherein an air flow is induced through the air passage from the air inlet to the air outlet for cooling at least some of the electrical components; and a cooling heat exchanger that is disposed in the external housing and that is connected to the refrigerant circuit, wherein the air flow flows through the cooling heat exchanger, the cooling heat exchanger exchanges heat between the refrigerant and the air flow, and a bottom end portion of the cooling heat exchanger is tilted downward towards an air outlet of the cooling heat exchanger.

13. A heat source unit for an air conditioner that comprises a refrigerant circuit, the heat source unit comprising:

an external housing that accommodates:

a compressor connected to the refrigerant circuit;

a heat source heat exchanger that is connected to the refrigerant circuit and that exchanges heat between a refrigerant circulating in the refrigerant circuit and a heat source; and an electric box that:

includes a top wall and a plurality of side walls;

accommodates electrical components that control the air conditioner; and further includes an air passage comprising an air inlet and an air outlet, wherein an air flow is induced through the air passage from the air inlet to the air outlet for cooling at least some of the electrical components; and a cooling heat exchanger that is disposed in the external housing and that is connected to the refrigerant circuit, wherein the air flow flows through the cooling heat exchanger, the cooling heat exchanger exchanges heat between the refrigerant and the air flow, and the electric box and the cooling heat exchanger are independently supported in the external housing.

14. The heat source unit according to claim 13, further comprising:

a refrigerant piping that is:

disposed in the external housing;

connected to the cooling heat exchanger and the refrigerant circuit, wherein the refrigerant piping is supported independently from the electric box.

15. The heat source unit according to claim 13, further comprising:

a support structure, wherein the cooling heat exchanger and the electric box are fixed to the support structure independent from one another.

16. The heat source unit according to claim 15, wherein a first end of the electric box is hinged to the support structure, a second end of the electric box opposite to the first end is releasably fixed to the support structure, and the electric box is rotatable about an axis of rotation into a maintenance position by releasing the second end from the support structure.

17. The heat source unit according to claim 16, wherein the first end is a bottom end, and the axis of rotation is substantially horizontal.

18. The heat source unit according to claim 16, wherein the electric box is hinged to the support structure by one of the electric box or the support structure comprising opposite bosses that are respectively engaged with slots in the other of the support structure or the electric box.

19. The heat source unit according to claim 18, wherein when the electric box is in the maintenance position, the slots are shaped to prevent disengagement of the bosses from the slots.

20. A heat source unit for an air conditioner that comprises a refrigerant circuit, the heat source unit comprising:

an external housing that accommodates:

a compressor connected to the refrigerant circuit;

a heat source heat exchanger that is connected to the refrigerant circuit and that exchanges heat between a refrigerant circulating in the refrigerant circuit and a heat source; and an electric box that:

includes a top wall and a plurality of side walls;

accommodates electrical components that control the air conditioner; and further includes an air passage comprising an air inlet and an air outlet, wherein an air flow is induced through the air passage from the air inlet to the air outlet for cooling at least some of the electrical components; and a cooling heat exchanger that is disposed in the external housing and that is connected to the refrigerant circuit, wherein the air flow flows through the cooling heat exchanger, the cooling heat exchanger exchanges heat between the refrigerant and the air flow, a seal is disposed between the cooling heat exchanger and the electric box, and a center of gravity of the electric box is located between an axis of rotation of the electric box and a plane of a contact surface of the seal.

21. A heat source unit for an air conditioner that comprises a refrigerant circuit, the heat source unit comprising:

an external housing that accommodates:

a compressor connected to the refrigerant circuit;

a heat source heat exchanger that is connected to the refrigerant circuit and that exchanges heat between a refrigerant circulating in the refrigerant circuit and a heat source; and an electric box that:

includes a top wall and a plurality of side walls;

accommodates electrical components that control the air conditioner; and further includes an air passage comprising an air inlet and an air outlet, wherein an air flow is induced through the air passage from the air inlet to the air outlet for cooling at least some of the electrical components;

a cooling heat exchanger that is disposed in the external housing and that is connected to the refrigerant circuit, a first electric wire connected to a first electrical component, among the electrical components, in the electric box; and a first device disposed in the external housing, wherein the air flow flows through the cooling heat exchanger, the cooling heat exchanger exchanges heat between the refrigerant and the air flow, the electric box has a first opening at a bottom end, and the first electric wire is guided from the first electrical component to the first device through the first opening.

* * * * *